US010959026B2

(12) United States Patent
Slaney et al.

(10) Patent No.: US 10,959,026 B2
(45) Date of Patent: Mar. 23, 2021

(54) PARTIAL HRTF COMPENSATION OR PREDICTION FOR IN-EAR MICROPHONE ARRAYS

(71) Applicant: X Development LLC, Mountain View, CA (US)

(72) Inventors: Malcolm Slaney, Mountain View, CA (US); Ricardo Garcia, Mountain View, CA (US); William Woods, Mountain View, CA (US); Jason Rugolo, Mountain View, CA (US)

(73) Assignee: X Development LLC, Mountain View, CA (US)

( * ) Notice: Subject to any disclaimer, the term of this patent is extended or adjusted under 35 U.S.C. 154(b) by 0 days.

(21) Appl. No.: 16/522,394

(22) Filed: Jul. 25, 2019

(65) Prior Publication Data

US 2021/0029472 A1 Jan. 28, 2021

(51) Int. Cl.

| | |
|---|---|
| ***H04R 25/02*** | (2006.01) |
| ***H04R 25/00*** | (2006.01) |
| ***H04R 1/10*** | (2006.01) |

(52) U.S. Cl.

CPC ..... *H04R 25/02* (2013.01); *H04R 1/1016* (2013.01); *H04R 25/30* (2013.01); *H04R 25/405* (2013.01)

(58) Field of Classification Search

CPC ..... H04R 25/02; H04R 25/405; H04R 25/30; H04R 1/1016

See application file for complete search history.

(56) References Cited

U.S. PATENT DOCUMENTS

2004/0218771 A1 11/2004 Chalupper et al.
2010/0092016 A1 4/2010 Iwano et al.
2019/0394576 A1* 12/2019 Petersen ..... H04R 25/453

FOREIGN PATENT DOCUMENTS

EP 2611218 A1 7/2013

OTHER PUBLICATIONS

Phonak, "Real Ear Sound: A Simulation of the Pinna Effect Optimizes Sound Localization Also With Open Fittings," microSavia: Field Study News, 2005, 2 pages.

(Continued)

*Primary Examiner* — Tuan D Nguyen
(74) *Attorney, Agent, or Firm* — Christensen O'Connor Johnson Kindness PLLC

(57) ABSTRACT

In some embodiments, an ear-mounted sound reproduction system is provided. The system includes an ear-mountable housing that sits within the pinna of the ear and occludes the ear canal. In some embodiments, the ear-mountable housing includes a plurality of external-facing microphones. Because the external-facing microphones may be situated within the pinna of the ear but outside of the ear canal, the microphones will experience some, but not all, of the three-dimensional acoustic effects of the pinna. In some embodiments, sound is reproduced by an internal-facing driver element of the housing using a plurality of filters applied to the signals received by the plurality of external-facing microphones to preserve three-dimensional localization cues that would be present at the eardrum in the absence of the housing, such that the housing is essentially transparent to the user. In some embodiments, techniques are provided for deriving the plurality of filters.

21 Claims, 9 Drawing Sheets

(56) References Cited

OTHER PUBLICATIONS

Salvador, C.D., et al., "Design Theory for Binaural Synthesis: Combining Microphone Array Recordings and Head-Related Transfer Function Datasets," Acoustical Science and Technology 38(2):51-62, 2017.

International Search Report and Written Opinion dated Oct. 19, 2020 in International Patent Application No. PCT/US2020/040674, 12 pages.

* cited by examiner

PARTIAL HRTF COMPENSATION OR PREDICTION FOR IN-EAR MICROPHONE ARRAYS

TECHNICAL FIELD

This disclosure relates generally to in-ear audio devices.

BACKGROUND

Headphones are a pair of loudspeakers worn on or around a user's ears. Circumaural headphones use a band on the top of the user's head to hold the speakers in place over or in the user's ears. Another type of headphone is known as an earbud or earpiece, and includes units that are worn within the pinna of the user's ear, close to the user's ear canal.

Both headphones and ear buds are becoming more common with increased use of personal electronic devices. For example, people use headphones to connect to their phones to play music, listen to podcasts, etc. As another example, people who experience hearing loss also use ear-mounted devices to amplify environmental sounds. However, headphone devices are currently not designed for all-day wear since their presence blocks outside noise from entering the ear. Thus, the user is required to remove the devices to hear conversations, safely cross streets, etc. Further, ear-mounted devices for those who experience hearing loss often fail to accurately reproduce environmental cues, thus making it difficult for wearers to localize reproduced sounds.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In some embodiments, an ear-mounted sound reproduction system is provided. The system comprises a housing, a plurality of microphones, a driver element, and a sound processing device. The housing has an internally directed portion and an externally directed portion. The plurality of microphones are mounted on the externally directed portion of the housing. The housing is shaped to position the plurality of microphones at least partially within a pinna of an ear. The driver element is mounted on the internally directed portion of the housing. The sound processing device includes logic that, in response to execution, causes the ear-mounted sound reproduction system to perform operations including receiving a set of signals, each signal of the set of signals received from a microphone of the plurality of microphones; for each signal of the set of signals, processing the signal using a filter associated with the microphone from which the signal was received to generate a separate filtered signal; combining the separate filtered signals to create a combined signal; and providing the combined signal to the driver element for emission.

In some embodiments, a computer-implemented method of optimizing output of a plurality of ear-mounted microphones is provided. A plurality of microphones of a device inserted into an ear receive input signals from a plurality of sound sources. For each microphone of the plurality of microphones, the input signals received by the microphone are processed using a separate filter to create separate processed signals. The separate processed signals are combined to create combined output signals. The combined output signals are compared to reference signals. The separate filters are adjusted to minimize differences between the combined output signals and the reference signals. The adjusted filters are stored for use by a controller of the device.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

In some embodiments of the present disclosure, an ear-mounted sound reproduction system is provided. The system includes an ear-mountable housing that sits within the pinna of the ear and occludes the ear canal. In some embodiments, the ear-mountable housing includes a plurality of external-facing microphones. Because the external-facing microphones may be situated within the pinna of the ear but outside of the ear canal, the microphones will experience some, but not all, of the three-dimensional acoustic effects of the pinna. What is desired is for sound reproduced by an internal-facing driver element of the housing to preserve three-dimensional localization cues that would be present at the eardrum in the absence of the housing, such that the housing is essentially transparent to the user.

Figure 1:
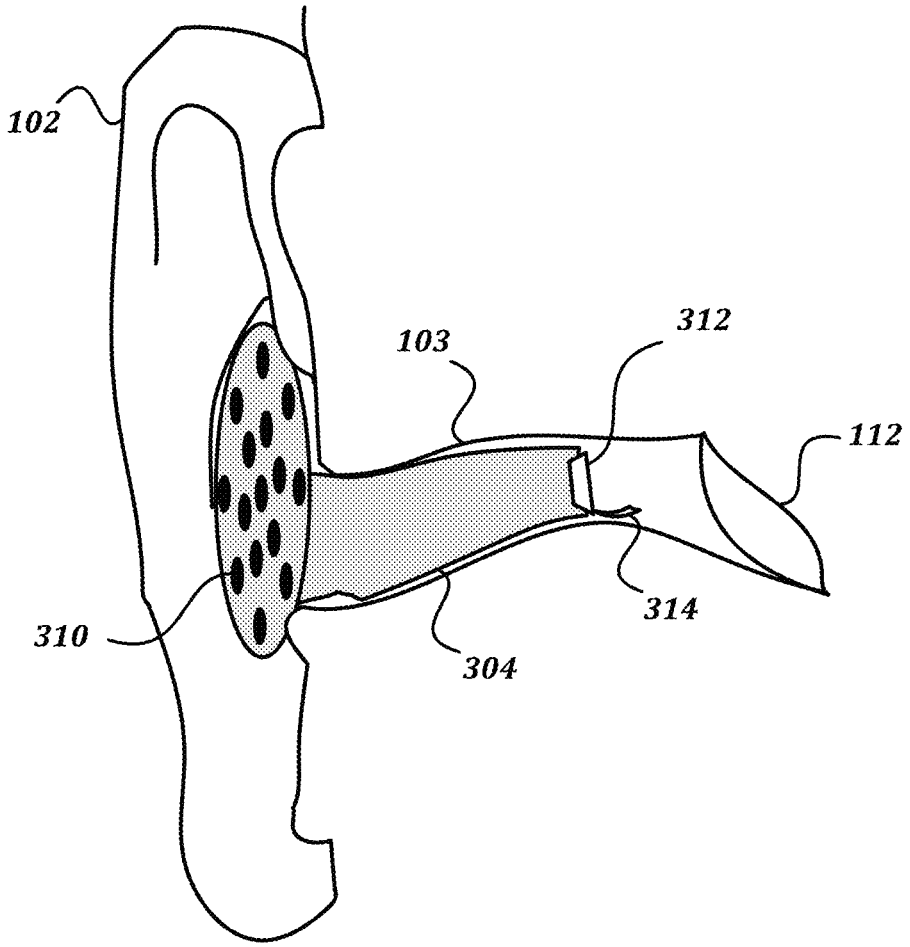
FIG. 1 is a schematic drawing that shows a partial cutaway view of a non-limiting example embodiment of a device according to various aspects of the present disclosure.

FIG. 1 is a schematic drawing that shows a partial cutaway view of a non-limiting example embodiment of a device according to various aspects of the present disclosure. As seen in the drawing, an ear-mountable housing 304 is inserted within an ear canal 103 of an ear. An externally directed portion of the housing includes a plurality of microphones 310. Though illustrated in FIG. 1 as being disposed in a single plane, in some embodiments, the plurality of microphones 310 may be disposed on the externally directed portion of the housing in a semi-spherical or other arrangement that is not a single plane. An internally directed portion of the housing occludes the ear canal 103, and includes at least a driver element 312. The illustrated embodiment also includes an optional in-ear microphone 314. The driver element 312 is configured to generate sound to be received by the eardrum 112.

Figure 2:
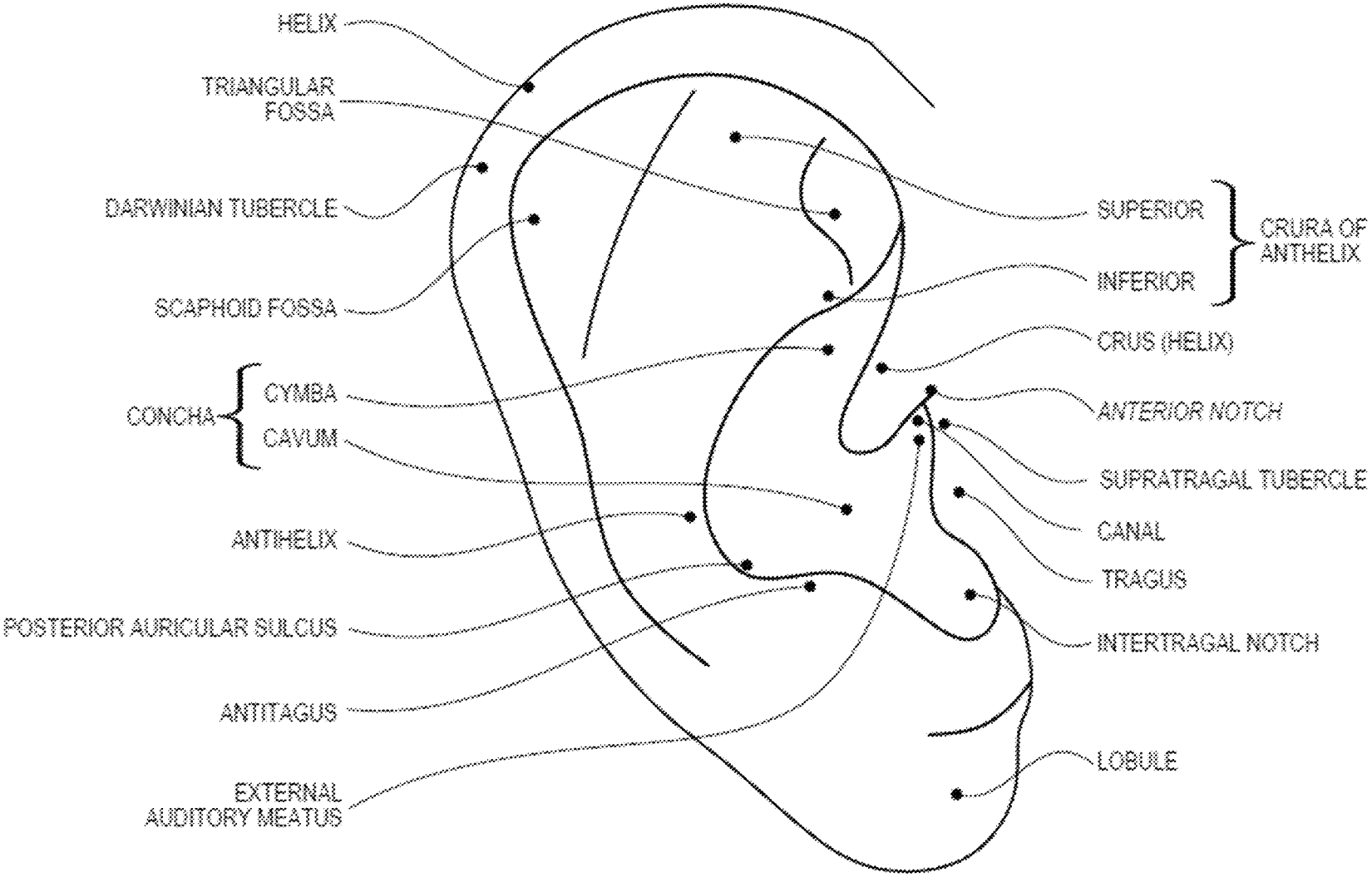
FIG. 2 is a cartoon drawing that indicates various elements of the anatomy of the pinna, for reference.

As shown, the ear-mountable housing 304 is inserted such that the plurality of microphones 310 are located at least partially within a pinna 102 of the ear. For example, the externally directed portion of the ear-mountable housing 304 may be positioned outside of the ear canal 103 but inside the concha, behind the tragus/antitragus, or otherwise within a portion of anatomy of the pinna. FIG. 2 is a cartoon drawing that indicates various elements of the anatomy of the pinna, for reference. Because the microphones 310 are at least partially within the pinna 102, the microphones 310 will experience some of the three-dimensional acoustic effects imparted by the pinna 102. This is unlike a set of over-the-ear headphones with an externally mounted microphone array, at least because the loudspeaker for over-the-ear headphones is outside of the pinna (as are the microphones), and so such headphones constitute a closed system for which three-dimensional auditory cues can easily be reproduced without complex processing. In contrast, the microphones 310 receive some, but not all, of the three-dimensional acoustic effects imparted by the pinna 102. Accordingly, in order to cause the driver element 312 to accurately reproduce the three-dimensional acoustic effects that would be received at the eardrum 112 in the absence of the housing 304, filters should be determined such that the signals from the microphones 310 can be combined to accurately reproduce such effects. Once filters are determined that can provide transparency, further functionality, such as beamforming, may be provided as well.

Figure 3:
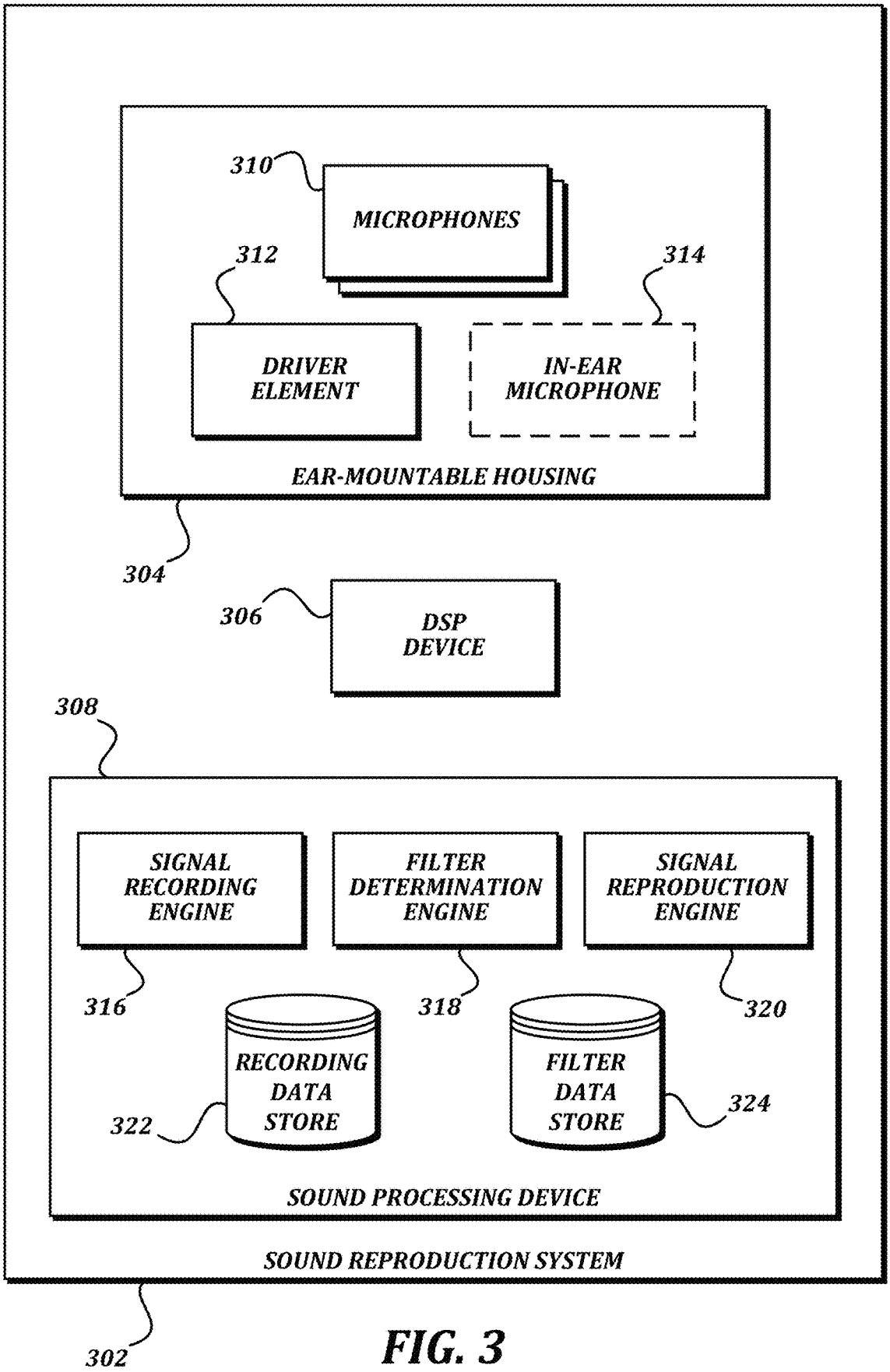
FIG. 3 is a block diagram that illustrates a non-limiting example embodiment of a sound reproduction system according to various aspects of the present disclosure.

FIG. 3 is a block diagram that illustrates a non-limiting example embodiment of a sound reproduction system according to various aspects of the present disclosure. In some embodiments, the sound reproduction system 302 is configured to discover filters for the signals received by a plurality of microphones 310 of an ear-mountable housing 304 in order to achieve one or more sound reproduction goals. In some embodiments, the sound reproduction system 302 is configured to use such filters in order to reproduce sound received by the microphones 310 using the driver element 312. As illustrated, the sound reproduction system 302 comprises an ear-mountable housing 304, a digital signal processor (DSP) device 306, and a sound processing device 308. In some embodiments, the ear-mountable housing 304, DSP device 306, and sound processing device 308 may be communicatively connected to each other using any suitable communication technology, including but not limited to wired technologies including but not limited to Ethernet, USB, Thunderbolt, Firewire, and analog audio connectors; and wireless technologies including but not limited to Wi-Fi and Bluetooth.

In some embodiments, the ear-mountable housing 304 includes a plurality of microphones 310, a driver element 312, and an optional in-ear microphone 314. The ear-mountable housing 304 includes an internally directed portion and an externally directed portion. The externally directed portion and the internally directed portion together enclose a volume in which other components, including but not limited to at least one of a battery, a communication interface, and a processor, may be provided.

In some embodiments, the internally directed portion is shaped to fit within an ear canal of a user, and may be retained in the ear canal with a friction fit. In some embodiments, the internally directed portion may be custom-formed to the particular shape of the ear canal of a particular user. In some embodiments, the internally directed portion may completely occlude the ear canal. The driver element 312 and optional in-ear microphone 314 may be mounted at a distal end of the internally directed portion.

In some embodiments, the externally directed portion may include a surface on which the microphones 310 are mounted. In some embodiments, the externally directed portion may have a circular shape with the microphones 310 distributed through the circular shape. In some embodiments, the externally directed portion may have a shape that is custom formed to coincide with the anatomy of the pinna of the user. In some embodiments, the externally directed portion may include a planar surface, such that the microphones 310 are disposed in a single plane. In some embodiments, the externally directed portion may include a semi-spherical structure or some other shape upon which the microphones 310 are disposed, such that the microphones 310 are not disposed in a single plane. In some embodiments, when the ear-mountable housing 304 is positioned within the ear, the plane in which the microphones 310 are situated is angled to the front of the head.

In some embodiments, the microphones of the plurality of microphones 310 may be any type of microphone with a suitable form factor, including but not limited to MEMS microphones. In some embodiments, the driver element 312 may be any type of high-definition loudspeaker capable of generating a full range of audible frequencies (e.g., from about 50 Hz to about 20 KHz). In some embodiments, the in-ear microphone 314 may also be any type of microphone with a suitable form factor, including but not limited to MEMS microphones. The in-ear microphone 314 may be optional, because in some embodiments, only a separate microphone may be used to measure the performance of the driver element 312.

As stated above, the sound reproduction system 302 also includes a DSP device 306. In some embodiments, the DSP device 306 is configured to receive analog signals from the microphones 310 and to convert them into digital signals to be processed by the sound processing device 308. In some embodiments, the DSP device 306 may also be configured to receive digital signals from the sound processing device 308, to convert the digital signals into analog signals, and to provide the analog signals to the driver element 312 for reproduction. One non-limiting example of a device suitable for use as a DSP device 306 is an ADAU1467Z SigmaDSP® processor provided by Analog Devices, Inc.

As shown, the sound processing device 308 includes a signal recording engine 316, a filter determination engine 318, a signal reproduction engine 320, a recording data store 322, and a filter data store 324. In some embodiments, the signal recording engine 316 is configured to receive digital signals from the DSP device 306 and to store the received signals in the recording data store 322. The signal recording engine 316 may also store indications of a particular microphone 310 and/or sound source associated with a received signal. In some embodiments, the filter determination engine 318 is configured to determine filters that can be applied to signals received from the microphones 310 such that the processed signals may be combined to generate a combined signal that is as close as possible to matching a signal that would be received at the eardrum in the absence of the ear-mountable housing 304. The filter determination engine 318 may be configured to store the determined filters in the filter data store 324. In some embodiments, the signal reproduction engine 320 is configured to apply the filters to signals received from the DSP device 306, and to provide a combined processed signal to the DSP device 306 to be reproduced by the driver element 312.

In general, the term "engine" as used herein refers to logic embodied in hardware or software instructions, which can be written in a programming language, such as C, C++, COBOL, JAVA™, PHP, Perl, HTML, CSS, JavaScript, VBScript, ASPX, Microsoft .NET™ languages such as C#, application-specific languages such as Matlab, and/or the like. An engine may be compiled into executable programs or written in interpreted programming languages. Engines may be callable from other engines or from themselves. Generally, the engines described herein refer to logical modules that can be merged with other engines or applications, or can be divided into sub-engines. The engines can be stored in any type of computer readable medium or computer storage device and be stored on and executed by one or more general purpose computers, thus creating a special purpose computer configured to provide the engine. Accordingly, the devices and systems illustrated herein include one or more computing devices configured to provide the illustrated engines.

In general, a "data store" as described herein may be provided by any suitable device configured to store data for access by a computing device. One example of a data store is a highly reliable, high-speed relational database management system (RDBMS) executing on one or more computing devices and accessible locally or over a high-speed network. However, any other suitable storage technique and/or device capable of quickly and reliably providing the stored data in response to queries may be used, such as a key-value store, an object database, and/or the like. The computing device providing the data store may be accessible locally instead of over a network, or may be provided as a cloud-based service. A data store may also include data stored in an organized manner on a computer-readable storage medium, as described further below. Another example of a data store is a file system or database management system that stores data in files (or records) on a computer readable medium such as flash memory, random access memory (RAM), hard disk drives, and/or the like. Separate data stores described herein may be combined into a single data store, and/or a single data store described herein may be separated into multiple data stores, without departing from the scope of the present disclosure.

As illustrated, the sound reproduction system 302 includes separate devices for the ear-mountable housing 304, the DSP device 306, and the sound processing device 308. In some embodiments, the functionality described as being provided by the sound processing device 308 may be provided by one or more application-specific integrated circuits (ASICs), field programmable gate arrays (FPGAs), or any other type of hardware with circuitry for implementing logic. In some embodiments, the functionality described as being provided by the sound processing device 308 may be embodied by instructions stored within a computer-readable medium, and may cause the sound reproduction system 302 to perform the functionality in response to executing the instructions. In some embodiments, the functionality of the sound processing device 308 may be provided by a MOTU soundcard and a computing device such as a laptop computing device, desktop computing device, server computing device, or cloud computing device running digital audio workstation (DAW) software such as Pro Tools, Studio One, Cubase, or MOTU Digital Performer. The DAW software may be enhanced with a virtual studio technology (VST) plugin to provide the engine functionality. Further numerical analysis conducted by the engines may be performed in mathematical analysis software such as matlab. In some embodiments, the functionality of the DSP device 306 may also be provided by software executed by the sound processing device 308, such as MAX msp provided by Cycling '74, or Pure Data (PD).

In some embodiments, functionality of the DSP device 306 may be incorporated into the ear-mountable housing 304 or the sound processing device 308. In some embodiments, all of the functionality may be located within the ear-mountable housing 304. In some embodiments, some of the functionality described as being provided by the sound processing device 308 may be provided instead within the ear-mountable housing 304. For example, a separate sound processing device 308 may provide the signal recording engine 316, filter determination engine 318, and recording data store 312 in order to determine the filters to be used, while the functionality of the filter data store 324 and signal reproduction engine 320 may be provided by the ear-mountable housing 304.

FIGS. 4A-4D are a flowchart that illustrates a non-limiting example embodiment of a method for discovering and using filters for compensating for a partial head-related transfer function in an ear-mounted microphone array according to various aspects of the present disclosure. At a high level, the method 400 determines a target signal within an ear simulator 503 for signals generated by a plurality of sound sources. An ear-mountable housing 304 is then placed within the ear simulator 503, and signals are recorded by each of the microphones 310. The sound processing device 308 then determines filters that minimize the differences between the signals recorded by the microphones 310 and the reference signal. The determined filters can be used to generate signals using the driver element 312.

In some embodiments, a goal of the method 400 is to be able to combine the signals from the M microphones of the plurality of microphones 310 such that the frequency response of the combined signals matches a given target signal as closely as possible. The expression A(f, k, m) represents the complex-valued frequency response at a microphone m=1, 2, . . . , M for a sound source at position k=1, 2, . . . , K, at frequency f, and the expression T(f, k) represents a target frequency response for sound source k. The combination comprises filtering the microphone signals and adding together the filter outputs. The frequency response Y(f, k) of the overall output of the filtering and combination process can be written as follows:

$$Y(f,k)=\sum_{m=1}^{M}A(f,k,m)W(f,m)=A_k^T\cdot W$$

where W(f, m) is the frequency response of the $m^{th}$ filter being designed, $A_k$ is an M-element column vector with $m^{th}$ element A(f, k, M), T means matrix transpose, and W is an M-element column vector with $m^{th}$ element W(f, m). The design methods disclosed herein search for filters W(f, m) such that Y(f, k) matches T(f, k) given some matching criterion. The filtering and combination process can either be done in the frequency domain or by converting the W(f, m) filters to a set of M time-domain filters, or using similar design techniques in the time domain. By minimizing the error in the combined signal for a plurality of sound sources, filters can be determined that provide maximum performance for the device 304 regardless of the direction of the incoming sound. As discussed further below, similar techniques that use other optimizations (such as beamforming or otherwise prioritizing some directions over others) may also be used.

Figure 4A:
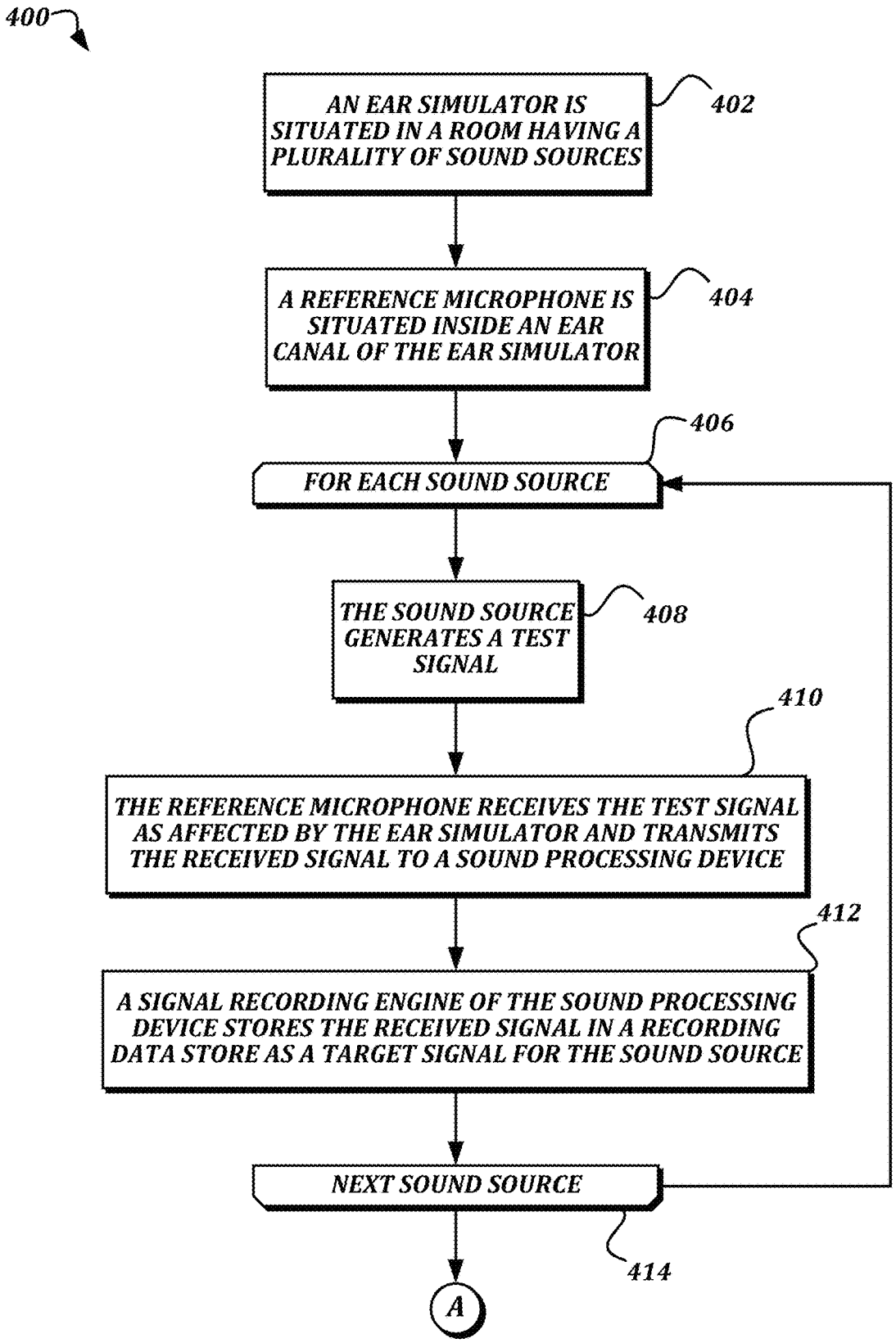
FIGS. 4A-4D are a flowchart that illustrates a non-limiting example embodiment of a method for discovering and using filters for compensating for a partial head-related transfer function in an ear-mounted microphone array according to various aspects of the present disclosure.
Figure 4B:
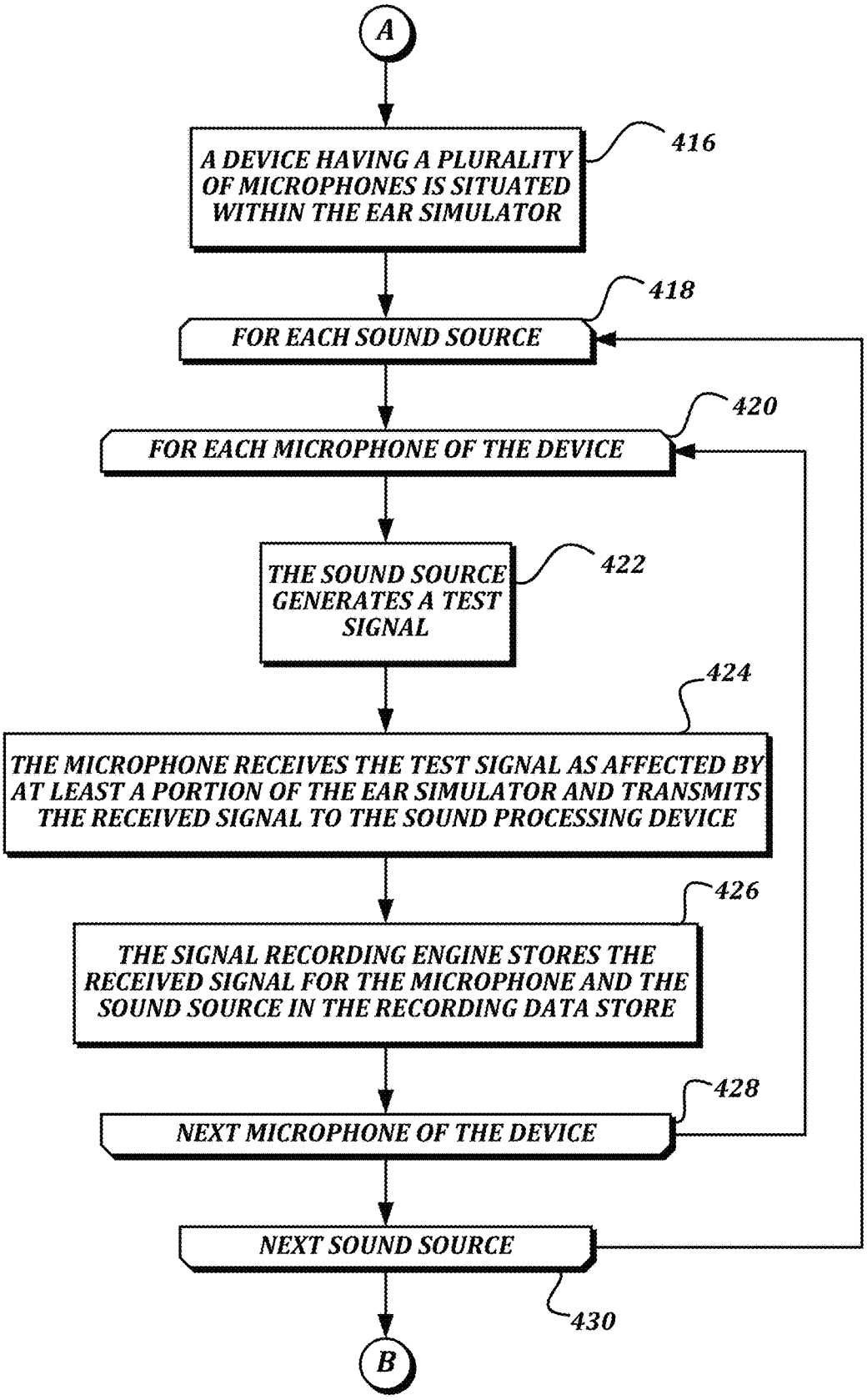
Figure 5A:
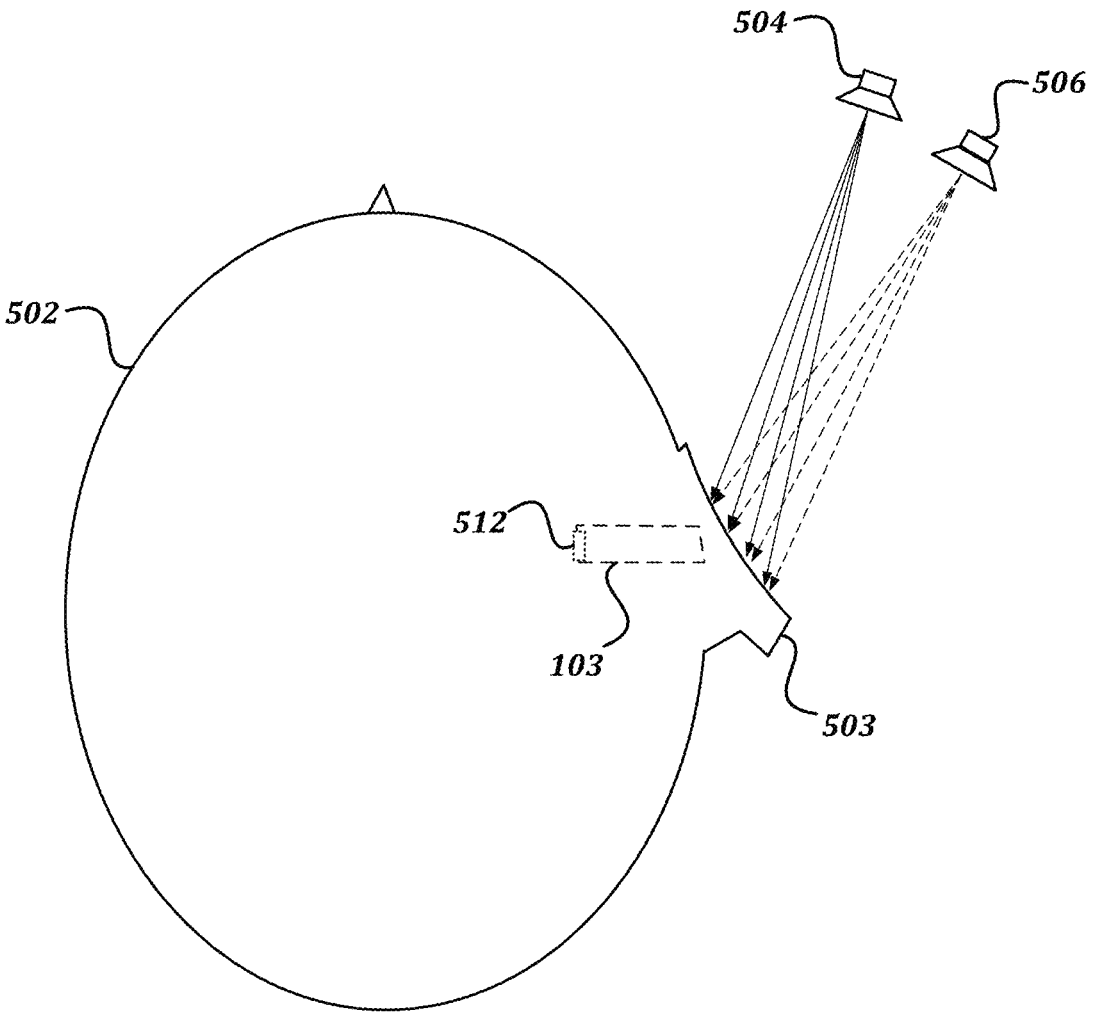
FIG. 5A illustrates a non-limiting example embodiment of an experimental setup according to various aspects of the present disclosure.

At block 402 (FIG. 4A), an ear simulator 503 is situated in a room having a plurality of sound sources, and at block 404, a reference microphone is situated inside an ear canal of the ear simulator 503. The use of an ear simulator instead of a live subject allows for the ear simulator to be accurately and repeatably situated within a test environment, and for precise acoustic measurements to be taken, though in some embodiments, a live subject may be used with an in-ear microphone. FIG. 5A illustrates a non-limiting example embodiment of an experimental setup according to various aspects of the present disclosure. As shown, an artificial head 502 is provided that includes an ear simulator 503. In some embodiments, the ear simulator 503 is shaped to approximate the anatomy of a real ear, and may be created of a material with similar acoustic properties to human skin, cartilage, and other components of a real ear. The artificial head 502 and ear simulator 503 include an ear canal 103. Situated within the ear canal 103 and approximating the location of an eardrum 112 is the reference microphone 512. In some embodiments, the reference microphone 512 may be a similar device as the microphones 310 of the ear-mountable housing 304, and may be communicatively coupled to the DSP device 306 in a similar way. In some embodiments, the reference microphone 512 may be a simpler device, such as a Dayton Audio UMM-6 USB microphone. In some embodiments, the reference microphone 512 may be in a location with known, fixed relation to the eardrum 112 location, such as at the entrance of the ear canal or at the position of the center of the head, but with the head not present. In some embodiments, the reference microphone 512 may be tuned to present air coupling parameters that match an average tympanic membrane.

FIG. 5A also illustrates a first sound source 504 and a second sound source 506 of a plurality of sound sources. Each sound source may be a loudspeaker such as a Sony SRSX5 portable loudspeaker that is communicatively coupled to a computing device configured to generate test signals. In some embodiments, the plurality of sound sources may include sixteen or more sound sources disposed around the artificial head 502. In some embodiments, the plurality of sound sources may be at a variety of horizontal and vertical positions in relation to the artificial head 502. Though not illustrated for the sake of simplicity, in some embodiments, the artificial head 502 may include a second ear simulator and reference microphone. In some embodiments, the artificial head 502 may also include an artificial torso, hair, clothing, accessories, and/or other elements that may contribute to a head-related transfer function. In some embodiments, the artificial head 502 and the plurality of sound sources may be located within an anechoic chamber in order to further reduce interference from environmental factors. In some embodiments, instead of having multiple devices to provide the multiple sound sources 504, 506, a single device may be moved to multiple locations to provide the multiple sound sources 504, 506 using a robotic arm or another technique for accurately replicating the multiple locations between experiments.

Though FIG. 5A illustrates an artificial head 502 and an ear simulator 503, in some embodiments, collecting the measurements may include a human subject. For such embodiments, an in-ear microphone may be situated close to the tympani within the real ear of the subject. The subject may be provided with a headrest or similar device to help the subject remain still and in a consistent position during the testing.

Returning to FIG. 4A, a for-loop is defined between a for-loop start block 406 and a for-loop end block 414, and is executed for each sound source of a plurality of sound sources disposed around the ear simulator 503. From the for-loop start block 406, the method 400 proceeds to block 408, where the sound source generates a test signal. Some non-limiting examples of test signals may include a sinusoidal sweep, speech, music, and/or combinations thereof. At block 410, the reference microphone 512 receives the test signal as affected by the ear simulator 503 and transmits the received signal to a sound processing device 308. In some embodiments, the reference microphone 512 provides the received signal to the DSP device 306, which then provides a digital form of the received signal to the sound processing device 308. In some embodiments, an analog-to-digital converter may be present in the reference microphone 512, and a digital audio signal may be provided by the reference microphone 512 to the sound processing device 308.

At block 412, a signal recording engine 316 of the sound processing device 308 stores the received signal in a recording data store 322 as a target signal for the sound source. If further sound sources remain to be processed, then the method 400 proceeds from the for-loop end block 414 to the for-loop start block 406 to process the next sound source. Otherwise, if all of the sound sources have been processed, then the method 400 proceeds from the for-loop end block 414 to a continuation terminal ("terminal A"). In some embodiments, each sound source of the plurality of sound sources is processed separately so that the readings obtained from each sound source do not interfere with each other.

Figure 5B:
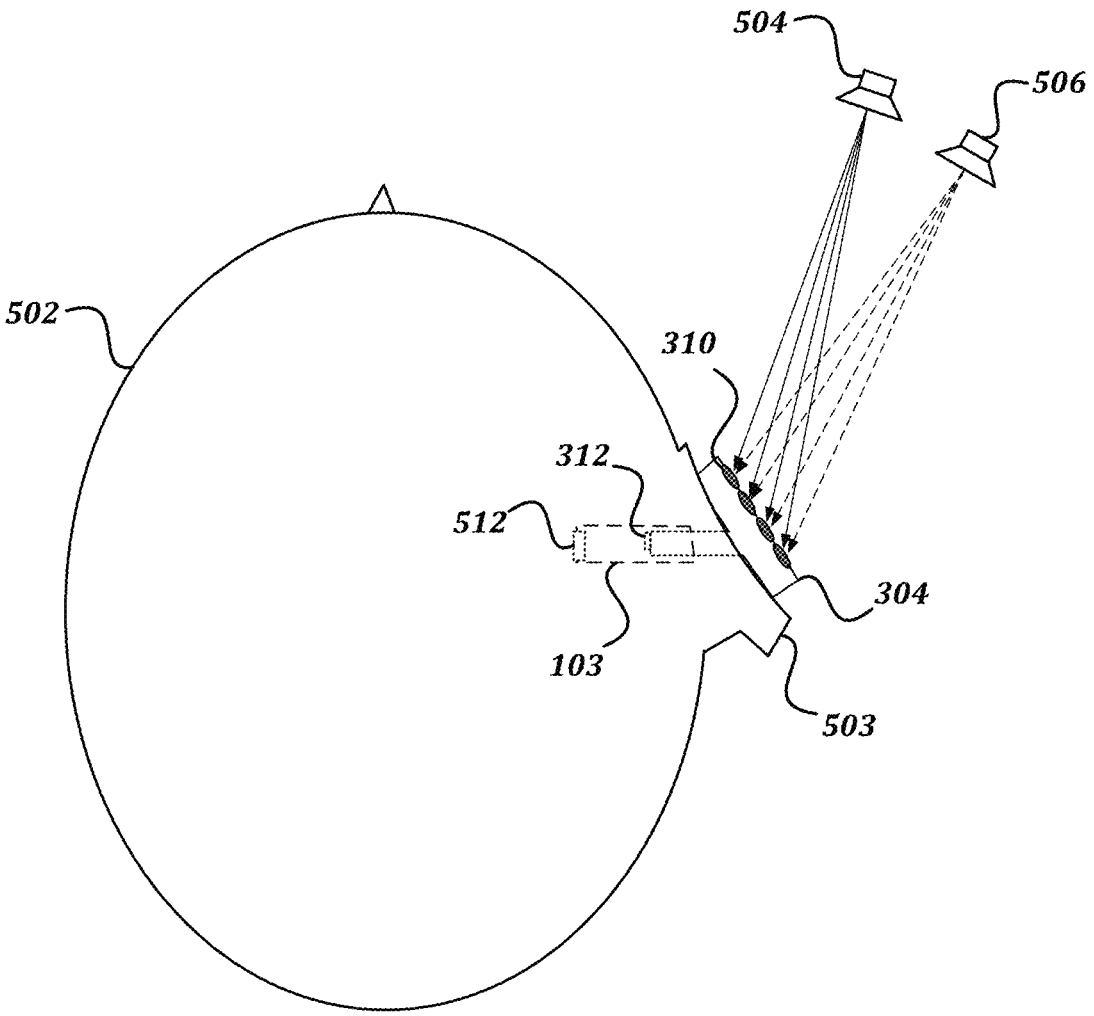
FIG. 5B illustrates a non-limiting example embodiment of the device being situated within the ear simulator illustrated in FIG. 5A.

At block 416 (FIG. 4B), a device 304 having a plurality of microphones 310 is situated within the ear simulator 503. The term device 304 is used interchangeably herein with the term ear-mountable housing 304. FIG. 5B illustrates a non-limiting example embodiment of the device 304 being situated within the ear simulator 503 illustrated in FIG. 5A and discussed above. The layout of the plurality of sound sources 504, 506 remains the same as illustrated and discussed above, as does everything else about the setup of the artificial head 502, ear simulator 503, and reference microphone 512. As shown, the signals from each of the sound sources 504, 506 will be received by each of the microphones 310 at a slightly different time and from a slightly different angle. The signals may also be partially occluded from directly reaching the microphone 310 or otherwise acoustically affected by a portion of the artificial head 502 or an artificial torso to which the artificial head 502 is mounted, particularly for sound sources located behind the artificial head 502 or on an opposite side of the artificial head 502 from the ear simulator 503. Though the device 304 is illustrated in FIG. 5B as extending outside of the ear simulator 503 for clarity, in actual embodiments, the device 304 would be partially within the ear simulator 503 such that the signals received by each of the microphones 310 are also affected by the acoustic properties of the ear simulator 503.

Returning to FIG. 4B, a for-loop is defined between a for-loop start block 418 and a for-loop end block 430, and is executed for each sound source of the plurality of sound sources disposed around the ear simulator 503. The sound sources of the plurality of sound sources for which the for-loop 418-430 is executed are the same as the sound sources for which the for-loop 406-414 was executed, though the order in which the sound sources are processed may change. From the for-loop start block 418, the method 400 proceeds to a for-loop defined between a for-loop start block 420 and a for-loop end block 428, which is executed for each microphone 310 of the device 104. In effect, the nested for-loops cause blocks 422-426 to be executed for every combination of sound source and microphone.

From the for-loop start block 420, the method 400 proceeds to block 422, where the sound source generates a test signal. The test signal is the same as the test signal generated at block 408. At block 424, the microphone 310 receives the test signal as affected by at least a portion of the ear simulator 503 and transmits the received signal to the sound processing device 308. In some embodiments, transmitting the received signal to the sound processing device 308 includes transmitting an analog signal from the microphone 310 to the DSP device 306, converting the analog signal to a digital signal, and transmitting the digital signal from the DSP device 306 to the sound processing device 308. At block 426, the signal recording engine 316 stores the received signal for the microphone 310 and the sound source in the recording data store 322.

If further microphones 310 remain to be processed for the sound source, then the method 400 proceeds from the for-loop end block 428 to the for-loop start block 420 to process the next microphone 310. Otherwise, if all of the microphones 310 have been processed, then the method 400 proceeds to the for-loop end block 430. If further sound sources remain to be processed, then the method 400 proceeds from the for-loop end block 430 to the for-loop start block 418 to process the next sound source. Otherwise, if all of the sound sources have been processed, then the method 400 proceeds to a continuation terminal ("terminal B").

Figure 4C:
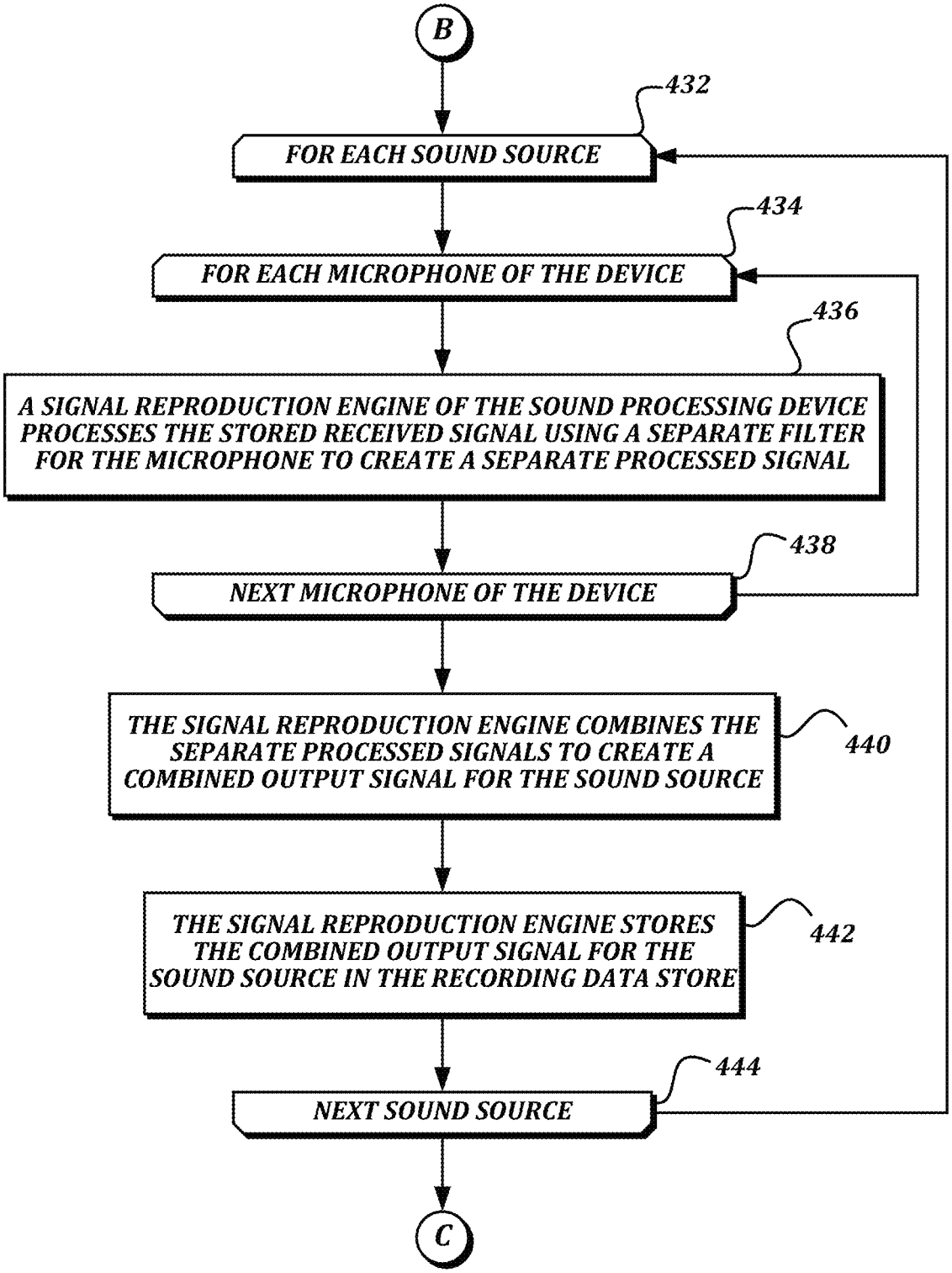
Figure 4D:
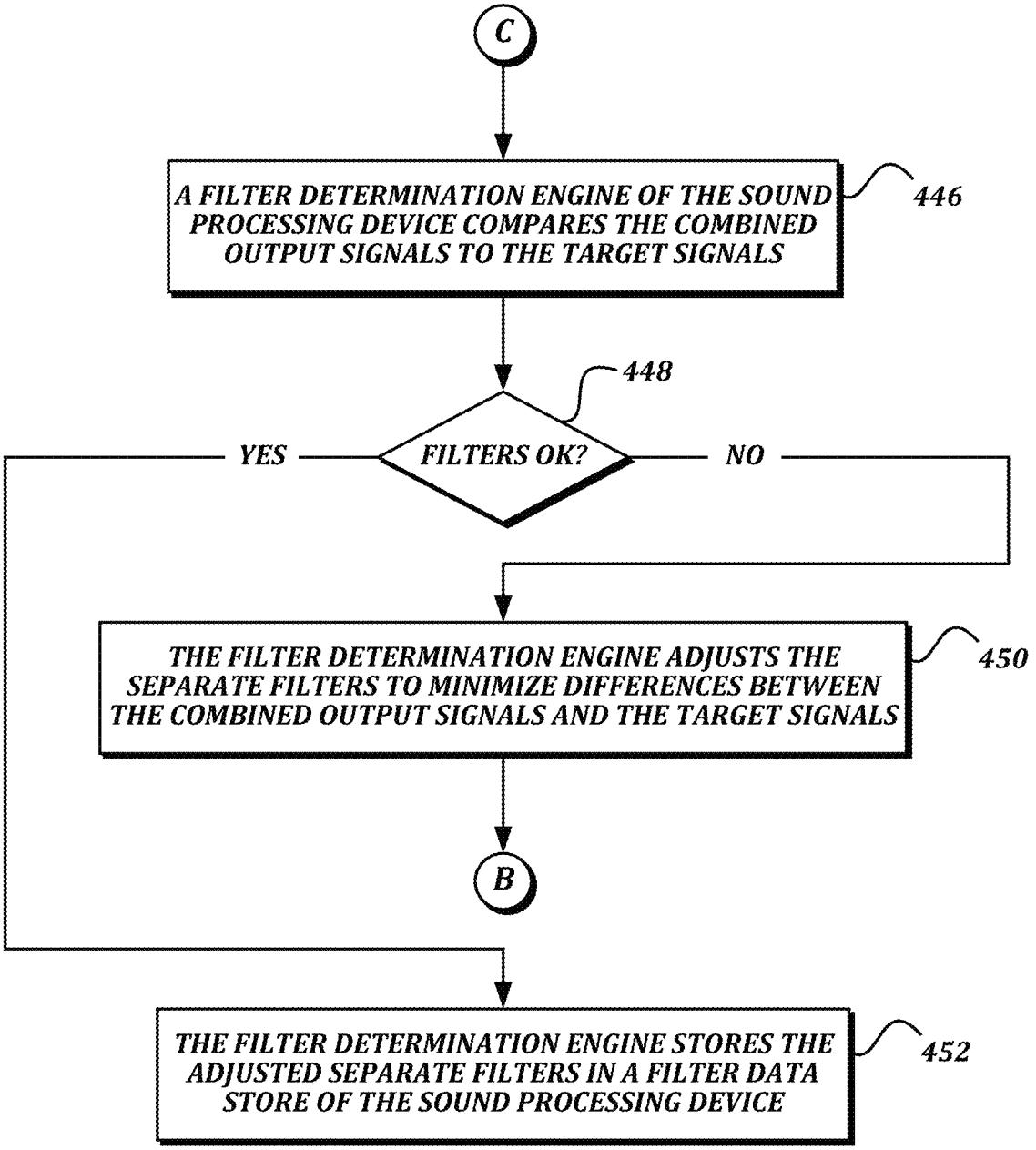

In FIG. 4C, a for-loop is defined between a for-loop start block 432 and a for-loop end block 444, and is executed for each sound source of the plurality of sound sources disposed around the ear simulator 503. From the for-loop start block 432, the method 400 proceeds to a for-loop start block 434, which starts another for-loop defined between for-loop start block 434 and for-loop end block 438. The for-loop defined between for-loop start block 434 and for-loop end block 438 is executed once for each microphone 310 of the plurality of microphones. In essence, these nested for-loops cause each of the signals received by the microphones 310 for each of the sound sources to be processed.

From for-loop start block 434, the method 400 proceeds to block 436, where a signal reproduction engine 320 of the sound processing device 308 processes the stored received signal using a separate filter for the microphone 310 to create a separate processed signal. In some embodiments, the separate filter is the filter to be applied to signals from a particular microphone 310 of the plurality of microphones. In some embodiments, the separate filter used for the first pass through block 436 for a particular microphone 310 may be a default filter which is adjusted later as discussed below.

If further microphones 310 remain to be processed, then the method 400 proceeds from the for-loop end block 438 to the for-loop start block 434 to process the stored received signal for the next microphone 310. Otherwise, if the stored received signals for all of the microphones 310 have been processed, then the method 400 proceeds from the for-loop end block 438 to block 440. At block 440, the signal reproduction engine 320 combines the separate processed signals to create a combined output signal for the sound source. At block 442, the signal reproduction engine 320 stores the combined output signal for the sound source in the recording data store 322.

The method 400 then proceeds to the for-loop end block 444. If further sound sources remain to be processed, then the method 400 proceeds from the for-loop end block 444 to the for-loop start block 432 to process the next sound source. Otherwise, if all of the sound sources have been processed, then the method 400 proceeds from the for-loop end block 444 to a continuation terminal ("terminal C").

At block 446 (FIG. 4D), a filter determination engine 318 of the sound processing device 308 compares the combined output signals to the target signals. In some embodiments, the comparison determines the squared difference between the signals, summed over positions, as indicated in the following equation:

$$C = \sum_{k=1}^{K} |T(f,k) - Y(f,k)|^2$$

This can also be expressed using vector notation as:

$$C=(T'-W'\cdot A')\cdot(T-A\cdot W)$$

where T is a K-element column vector with $k^{th}$ element T(f, k), and A is an M×K matrix with rows $A_k^T$, and A' is its complex-conjugate transpose.

At decision block 448, a determination is made regarding whether the performance of the existing filters is adequate. If it is determined that the performance of the existing filters is not adequate, then the result of decision block 448 is NO. At block 450, the filter determination engine 318 adjusts the separate filters to minimize differences between the combined output signals and the target signals, and then returns to terminal B to process the stored received signals using the newly adjusted filters.

The illustrated iterative method may include various optimization techniques for minimizing the combined errors. In some embodiments, the method may be able to compute ideal filters directly without looping back to re-test the filters. In some embodiments, to find the W that minimizes the squared difference error criterion described above, the gradient may be taken with respect to W* and set equal to zero, which yields:

$$\nabla C_{W^*}=0=-A'\cdot T+A'\cdot A\cdot W$$

And, finally, $$W=R^{-1}\cdot p$$

where R=A'·A, and p=A'·T.

In some embodiments, variations on the squared error described above may be used. For example, in some embodiments, a K×K diagonal matrix Q may be used to give more importance to some source positions than others, in order to ensure that signals from those source positions are the most accurately reproduced in the combination of processed signals. With scalar value $q_{kk}$ on the $k_{th}$ element of the diagonal, the resulting filter W will be more sensitive to positions k with larger values $q_{kk}$ than others with smaller values. For such embodiments, the criterion becomes:

$$C=(T'-W'\cdot A')\cdot Q\cdot(T-A\cdot W)$$

yielding:

$$W=R_Q^{-1}\cdot p_Q$$

with $R_Q$=A'·Q−·A, and $p_Q$=A'·Q·T.

In some embodiments, the criterion may use the squared difference, as discussed above, subject to constraining the filter to take on certain values for certain sound source positions. Let P be an M×N matrix whose N columns are the $A_k$ vectors corresponding to the constrained positions. Let G be an N-element column vector with the values to take on. Then, these additional constraints can be written P'·W=G. Using the method of Lagrange multipliers, the resulting W vector will be:

$$W=R^{-1}\cdot A'\cdot T-R^{-1}\cdot P\cdot(P'\cdot R^{-1}\cdot P)^{-1}\cdot(G-P'\cdot R^{-1}\cdot A'\cdot T)$$

Other criteria can be met using the theory of convex optimization. For example, in some embodiments, convex optimization may be used to find the filters that minimize the squared difference as above whilst limiting the maximum squared difference to be less than or equal to some predetermined threshold value.

Returning to decision block 448, if it is determined that the performance of the existing filters is adequate, then the result of decision block 448 is YES. At block 452, the filter determination engine 318 stores the adjusted separate filters in a filter data store 324 of the sound processing device 308.

In some embodiments, the adjusted separate filters may then be used by the signal reproduction engine 320 to generate signals to be reproduced by the driver element 312. For example, a live signal may be received from a sound source by the microphones 310. Each of the microphones 310 provides its received version of the live signal to the signal reproduction engine 320 (via the DSP device 306). The signal reproduction engine 320 processes the received live signals with the adjusted separate filters for the microphones 310, combines the processed live signals, and provides the combined processed live signal to the driver element 312 (via the DSP device 306) for reproduction.

The criteria described above are based on the frequency response as measured at a single device 304. In some embodiments, two devices (e.g., one in each ear of a listener) may be used. In such embodiments, another useful criterion would be related to preserving the ratio of the target responses at the two ears. With a left device and a right device, and the same set of filters applied separately to each array output, the ratio-based criterion at a given position k would be:

$$\frac{A_{kL}^T \cdot W}{(A_{kR}^T \cdot W)} = \frac{T_{kL}}{T_{kR}}$$

where subscript L and R mean left and right, respectively, and $T_{kL}$ and $T_{kR}$ are the target responses for source position k. This can be rearranged to yield:

$$(A_{kL}^T \cdot T_{kR} - A_{kR}^T \cdot T_{kL}) \cdot W = 0$$

The trivial solution W=0 should be avoided. One technique for avoiding the trivial solution is to constrain the filters such that they yield a certain result for a given position. Without loss of generality, one can specify that the previous equation be met exactly when k=0. To minimize the sum of squares of the above equation's left-hand side over all positions k subject to exactly satisfying it at k=0, the sum of squares can be written as:

$$\sum_k |(A_{kL}^T \cdot T_{kR} - A_{kR}^T \cdot T_{kL}) \cdot W|^2$$

and simplified to:

$$\sum_k |Z'_k \cdot W|^2 = \sum_k W' \cdot Z_k \cdot Z'_k \cdot W = W' \cdot R_Z \cdot W$$

where:

$$Z'_k = A_{kL}^T \cdot T_{kR} - A_{kR}^T \cdot T_{kL}$$

and:

$$R_Z = \sum_k Z_k \cdot Z'_k$$

Stated succinctly, we wish to minimize:

$$W' \cdot R_Z \cdot W$$

subject to:

$$A_{0L}^T \cdot W = T_{0L}$$

and:

$$A_{0R}^T \cdot W = T_{0R}$$

This formulation is the same as that of the linearly constrained, minimum variance beamformer, with solution:

$$W = R_Z^{-1} \cdot A_0 \cdot (A'_0 \cdot R_Z^{-1} A_0)^{-1} \cdot T_0$$

where:

$$A_0 = [A_{0L} A_{0R}] \text{ and } T_0 = [T_{0L} T_{0R}]^T$$

FIGS. 4A-4D illustrate blocks being performed in series. In some embodiments, the method 400 may include some of the blocks being performed in different orders than illustrated, or multiple times instead of only once. In some embodiments, portions of the method 400 may be conducted in parallel. For example, multiple computing threads or processes may be used to process stored received signals for multiple microphones 310 and/or sound sources at blocks 432-444 in parallel instead of serially.

Further, target responses can be the raw responses as measured with the method of FIG. 4A, or spatially smoothed versions of these target responses, or responses derived from knowledge of the user's anthropometry. In some embodiments, the microphone combination design process may not directly use the target responses but instead use a perceptual model of "spatial hearing" based on a set of target responses or other data. In some embodiments, the microphone signal combination process may be instantiated via a neural network instead of a linear filter.

In some embodiments, multiple sets of filters may be determined, and a "best" filter may be chosen for a given condition at runtime. For example, in some embodiments, a first filter may be determined for optimal performance in reproducing speech, a second filter may be determined for optimal performance in reproducing music, a third filter may be determined for optimal performance in noisy environments, and a fourth filter may be determined for optimal performance in a predetermined direction. At runtime, a filter may be chosen by the user, or may be performed automatically based on a detected environmental condition. In some embodiments, the switch between filters at runtime may be performed smoothly, by morphing coefficients over time, or by mixing audio generated using a first filter to audio generated using a second filter smoothly over time.

While illustrative embodiments have been illustrated and described, it will be appreciated that various changes can be made therein without departing from the spirit and scope of the invention.

The embodiments of the invention in which an exclusive property or privilege is claimed are defined as follows:

1. An ear-mounted sound reproduction system, comprising:

a housing having an internally directed portion and an externally directed portion;

a plurality of microphones mounted on the externally directed portion of the housing, wherein the housing is shaped to position the plurality of microphones at least partially within a pinna of an ear;

a driver element mounted on the internally directed portion of the housing; and a sound processing device including logic that, in response to execution, causes the ear-mounted sound reproduction system to perform operations including:

receiving a set of signals, each signal of the set of signals received from a microphone of the plurality of microphones;

for each signal of the set of signals, processing the signal using a filter associated with the microphone from which the signal was received to generate a separate filtered signal;

combining the separate filtered signals to create a combined signal; and providing the combined signal to the driver element for emission;

wherein processing the signal using a filter associated with the microphone from which the signal was received to generate a separate filtered signal includes processing the signal using a filter from a set of filters optimized to cause emission of the combined signal to simulate sound that would be received in an ear canal of a wearer without the presence of the housing.

2. The system of claim 1, wherein processing the signal using a filter associated with the microphone from which the signal was received to generate a separate filtered signal includes processing the signal using a filter from a set of filters optimized to increase reproduction of sounds received from one or more specified directions.

3. The system of claim 1, wherein processing the signal using a filter associated with the microphone from which the signal was received to generate a separate filtered signal includes processing the signal using a filter optimized based on a ratio of a target response between an ear in which the housing is mounted and another ear.

4. The system of claim 1, wherein the housing is shaped to completely occlude an ear canal of a wearer.

5. The system of claim 1, wherein the plurality of microphones are arranged in a single plane.

6. The system of claim 1, further comprising an in-ear microphone mounted on a portion of the housing shaped to be positioned within an ear canal of a wearer.

7. The system of claim 1, wherein the sound processing device is positioned within the housing.

8. A computer-implemented method of optimizing output of a plurality of ear-mounted microphones, the method comprising:

receiving, by a plurality of microphones of a device inserted into an ear, input signals from a plurality of sound sources;

for each microphone of the plurality of microphones, processing the input signals received by the microphone using a separate filter to create separate processed signals;

combining the separate processed signals to create combined output signals;

comparing the combined output signals to reference signals;

creating adjusted filters by adjusting the separate filters to minimize differences between the combined output signals and the reference signals; and storing the adjusted filters for use by a controller of the device.

9. The method of claim 8, wherein receiving, by a plurality of microphones of a device inserted into an ear, input signals from a plurality of sound sources includes:

receiving, by a plurality of microphones of a device inserted into an ear such that the plurality of microphones of the device are outside of an ear canal of the ear and inside a pinna of the ear, input signals from a plurality of sound sources.

10. The method of claim 8, wherein receiving input signals from a plurality of sound sources includes receiving input signals from a plurality of sound sources at different horizontal and vertical positions with respect to the ear.

11. The method of claim 8, wherein adjusting the separate filters to minimize differences between the combined output signals and the reference signals includes using principal component analysis to adjust the separate filters.

12. The method of claim 8, wherein adjusting the separate filters to minimize differences between the combined output signals and the reference signals includes adjusting the separate filters to minimize squared differences, summed over positions, between the combined output signals and the reference signals.

13. The method of claim 12, wherein adjusting the separate filters to minimize differences between the combined output signals and the reference signals further includes prioritizing at least one input signal more than other input signals.

14. The method of claim 13, wherein prioritizing differences for at least one input signal more than other input signals includes using a diagonal matrix to prioritize at least one input signal more than other input signals.

15. The method of claim 12, wherein adjusting the separate filters to minimize differences between the combined output signals and the reference signals includes forcing the separate filters to take on predetermined values for predetermined input signals.

16. The method of claim 12, wherein adjusting the separate filters to minimize differences between the combined output signals and the reference signals includes using convex optimization to minimize the squared differences while limiting maximum squared differences to be less than a threshold value.

17. The method of claim 8, wherein the ear is an ear simulator, and wherein the method further comprises:

collecting the reference signals by receiving, by a reference microphone inside the ear simulator, input signals from the plurality of sound sources before the device is inserted into the ear simulator.

18. The method of claim 8, wherein the ear is a real ear of a subject, and wherein the method further comprises:

collecting the reference signals by receiving, by an in-ear microphone inside the real ear, input signals from the plurality of sound sources before the device is inserted into the real ear.

19. The method of claim 8, wherein the device is a first device and the ear is a first ear of a head; and wherein the method further comprises:

receiving, by a second plurality of microphones of a second device inserted into a second ear of the head, the input signals from the plurality of sound sources, wherein the second plurality of microphones in the second device match the plurality of microphones in the first device;

for each microphone of the second plurality of microphones, processing the input signals received by the microphone using the separate filter of the matching microphone of the first device to create second separate processed signals;

combining the second separate processed signals to create second combined output signals; and comparing the second combined output signals to second reference signals;

wherein adjusting the separate filters to minimize differences between the combined output signals and the reference signals includes:

adjusting the separate filters to minimize differences between the combined output signals and the reference signals, to minimize differences between the second combined output signals and the second reference signals, and to preserve a ratio between the reference signals and the second reference signals.

20. An ear-mounted sound reproduction system, comprising:

a housing having an internally directed portion and an externally directed portion;

a plurality of microphones mounted on the externally directed portion of the housing, wherein the housing is shaped to position the plurality of microphones at least partially within a pinna of an ear;

a driver element mounted on the internally directed portion of the housing; and a sound processing device including logic that, in response to execution, causes the ear-mounted sound reproduction system to perform operations including:

receiving a set of signals, each signal of the set of signals received from a microphone of the plurality of microphones;

for each signal of the set of signals, processing the signal using a filter associated with the microphone from which the signal was received to generate a separate filtered signal;

combining the separate filtered signals to create a combined signal; and providing the combined signal to the driver element for emission;

wherein processing the signal using a filter associated with the microphone from which the signal was received to generate a separate filtered signal includes processing the signal using a filter optimized based on a ratio of a target response between an ear in which the housing is mounted and another ear.

21. The system of claim 20, wherein processing the signal using a filter associated with the microphone from which the signal was received to generate a separate filtered signal includes processing the signal using a filter from a set of filters optimized to increase reproduction of sounds received from one or more specified directions.

* * * * *